US011241736B2

(12) United States Patent
Akagi

(10) Patent No.: US 11,241,736 B2
(45) Date of Patent: Feb. 8, 2022

(54) POWDER MIXTURE FOR IRON-BASED POWDER METALLURGY, AND METHOD FOR MANUFACTURING SINTERED COMPACT USING SAME

(71) Applicant: KABUSHIKI KAISHA KOBE SEIKO SHO (Kobe Steel, Ltd.), Kobe (JP)

(72) Inventor: Nobuaki Akagi, Takasago (JP)

(73) Assignee: KABUSHIKI KAISHA KOBE SEIKO SHO (Kobe Steel, Ltd.), Kobe (JP)

( * ) Notice: Subject to any disclaimer, the term of this patent is extended or adjusted under 35 U.S.C. 154(b) by 264 days.

(21) Appl. No.: 16/464,890

(22) PCT Filed: Nov. 1, 2017

(86) PCT No.: PCT/JP2017/039491
§ 371 (c)(1),
(2) Date: May 29, 2019

(87) PCT Pub. No.: WO2018/100955
PCT Pub. Date: Jun. 7, 2018

(65) Prior Publication Data

US 2019/0283126 A1 Sep. 19, 2019

(30) Foreign Application Priority Data

Dec. 2, 2016 (JP) ..... JP2016-234807

(51) Int. Cl.

| | |
|---|---|
| ***B22F 1/00*** | (2006.01) |
| ***B22F 3/16*** | (2006.01) |
| ***B22F 3/02*** | (2006.01) |

(52) U.S. Cl.
CPC ..... *B22F 1/0003* (2013.01); *B22F 1/00* (2013.01); *B22F 3/02* (2013.01); *B22F 3/16* (2013.01);
(Continued)

(58) Field of Classification Search
CPC ..... B22F 1/00; B22F 1/0003; B22F 2302/25; B22F 3/16
See application file for complete search history.

(56) References Cited

U.S. PATENT DOCUMENTS 5,679,909 A 10/1997 Kaneko et al.
2018/0104739 A1 4/2018 Akagi
(Continued)

FOREIGN PATENT DOCUMENTS

JP 9-279203 A 10/1997
JP 9-279204 A 10/1997
(Continued)

OTHER PUBLICATIONS

JP2015172238 English (Year: 2021).*
(Continued)

*Primary Examiner* — Nicholas A Wang
*Assistant Examiner* — Jiangtian Xu
(74) *Attorney, Agent, or Firm* — Oblon, McClelland, Maier & Neustadt, L.L.P.

(57) ABSTRACT

The present invention relates to a powder mixture for iron-based powder metallurgy which is obtained by mixing an iron-based powder and at least one kind of powders selected from the group consisting of a Ca—Al—Si-based composite oxide powder and a Ca—Mg—Si-based composite oxide powder, in which with a peak height of a main phase exhibiting the highest peak intensity by X-ray diffraction as 100, the composite oxide powder has a relative height of 40% or less, with respect to the main phase, of a peak
(Continued)

height of a second phase having the second highest peak intensity.

8 Claims, 6 Drawing Sheets

(52) U.S. Cl.
CPC ..... *B22F 2301/35* (2013.01); *B22F 2302/25* (2013.01)

(56) References Cited

U.S. PATENT DOCUMENTS

| | | | | |
|---|---|---|---|---|
| 2018/0126454 | A1 | 5/2018 | Akagi | |
| 2018/0202029 | A1* | 7/2018 | Ueno | C03C 3/091 |

FOREIGN PATENT DOCUMENTS

| | | | |
|---|---|---|---|
| JP | H09279204 | * | 10/1997 |
| JP | 2010-236061 | A | 10/2010 |
| JP | 2015-172238 | A | 10/2015 |
| JP | 2015172238 | * | 10/2015 |

OTHER PUBLICATIONS

JP2015172238 translation (Year: 2021).*
JPH09279204 translation (Year: 2021).*
International Search Report dated Jan. 9, 2018 in PCT/JP2017/039491 filed on Nov. 1, 2017.
English translation of the International Preliminary Report on Patentability and Written Opinion of the International Searching Authority issued on Jun. 13, 2019 in PCT/JP2017/039491 filed Nov. 1, 2017, 7 pages.

* cited by examiner

POWDER MIXTURE FOR IRON-BASED POWDER METALLURGY, AND METHOD FOR MANUFACTURING SINTERED COMPACT USING SAME

TECHNICAL FIELD

The present invention relates to a powder mixture for iron-based powder metallurgy, and a method for manufacturing a sintered compact using the powder mixture for iron-based powder metallurgy.

BACKGROUND ART

Powder metallurgy is widely used as a method for industrial manufacturing technique of various machine parts. A procedure of manufacturing powder metallurgy part via iron-based powder is conducted in the following manner. First, a powder mixture of iron-based powder is prepared by mixing with iron-based powder, a powder for an alloy element such as a Copper (Cu) powder, a Nickel (Ni) powder, a Graphite powder, and a Lubricant. Next, admixed powder is filling into die and compress by compaction press for obtained green compact. The green compact is sintered at a temperature lower than a melting temperature of a main (major) material powder in admixed powder to have sintered compact. Then, the obtained sintered compact is subjected to machining such as drilling and turning to obtain an iron-based powder metallurgy part of a desired shape.

Ideal powder metallurgy is manufacturing a sintered compact so as to be applied as it is as a machine part without machining the sintered compact. However, the above sintering might cause ununiform shrinkage of a material powder mixture, which might result in causing a situation where a sintered compact cannot be applied as it is as a machine part. Also in recent years, as size precision demanded of a machine part is going tighter than before, complexed shape of a part, for example, of a double blade sprocket, makes it difficult to obtain a near net shape part by a conventional press-molding step.

Thus, it is becoming essential to process a sintered compact so as to have a desired shape by machining. With such a technical background, a technique has been considered for imparting excellent machinability to a sintered compact in order to smoothly perform machining the sintered compact.

As means for imparting machinability to a sintered compact, a method of adding an manganese sulfide (MnS) powder to a powder mixture is known. Machinability improvement mechanism by the adding MnS powder is considered to be achieved by impartation of sliding property, assistance of crack propagation, protection of a tool by formation of a built-up edge, and the like, and the method is therefore effective for machining at relatively low speed such as drilling. However, addition of an MnS powder does not always contribute to excellent machinability in recent high speed machining or in machining of hard sintered compact. Other problems also occur such as problems that a surface of a sintered compact is liable to have sooting during sintering and that mechanical strength of a sintered compact is liable to be reduced.

Under such conditions, there are provided various techniques for improving machinability of a sintered compact by a method different from the above addition of an MnS powder. For example, Patent Literature 1 proposes "a ferrous powdery mixture for powder metallurgy essentially consisting of iron powder and containing 0.02 to 0.3 wt. % of powder of a $CaO—Al_2O_3—SiO_2$-based composite oxide with an average particle size of 50 μm or less and having anorthite phases and/or gehlenite phases."

Patent Literature 2 proposes "an iron based mixed powder suitable to obtain a sintered member excellent in machinability in which $SiO_2—CaO—MgO$-based oxide powder is mixed with an iron-based powder for a sintered member in a proportion of 0.01 to 1.0 parts by mass relative to 100 parts by mass of the iron-based powder."

By the techniques recited in the above Patent Literatures 1 and 2, including a Ca—Al—Si-based composite oxide or a Ca—Mg—Si-based composite oxide in a member enables more excellent machinability to be exhibited without drastically reducing strength of a machine part than in an additive-free member. However, even when a particle size and a chemical component ratio of the above composite oxide are strictly adjusted, a slight difference in manufacturing conditions might largely change an amount of abrasion of a tool during machining.

When the amount of abrasion of a tool largely changes, a recent automatic machining line needs setting of the number of tools to be replaced on the assumption that the amount of abrasion of a tool is large. As a result, not only long-time automatic machining cannot be conducted but also a tool abraded so little that can be still used will be replaced uselessly, and therefore it is hardly said that excellent machinability is exhibited stably enough to meet a requirement in an automatic machining line.

The present invention was developed considering such circumstances as described above, and its object is to provide a powder mixture for iron-based powder metallurgy which enables production of a sintered compact that stably exhibits excellent machinability without having, when used as a tool, an amount of abrasion of a machining tool changing during machining, and a method useful for manufacturing such a sintered compact.

CITATION LIST

Patent Literature

Patent Literature 1: Japanese Patent No. 3449110

Patent Literature 2: Japanese Unexamined Patent Publication No. 2010-236061

SUMMARY OF INVENTION

A powder mixture for iron-based powder metallurgy according to one aspect of the present invention is a powder mixture which is obtained by mixing an iron-based powder and at least one kind of powders selected from the group consisting of a Ca—Al—Si-based composite oxide powder and a Ca—Mg—Si-based composite oxide powder, in which with a peak height of a main phase exhibiting the highest peak intensity by X-ray diffraction as 100, the composite oxide powder has a relative height of 40% or less, with respect to the main phase, of a peak height of a second phase having the second highest peak intensity.

DESCRIPTION OF EMBODIMENTS

Figure 1:
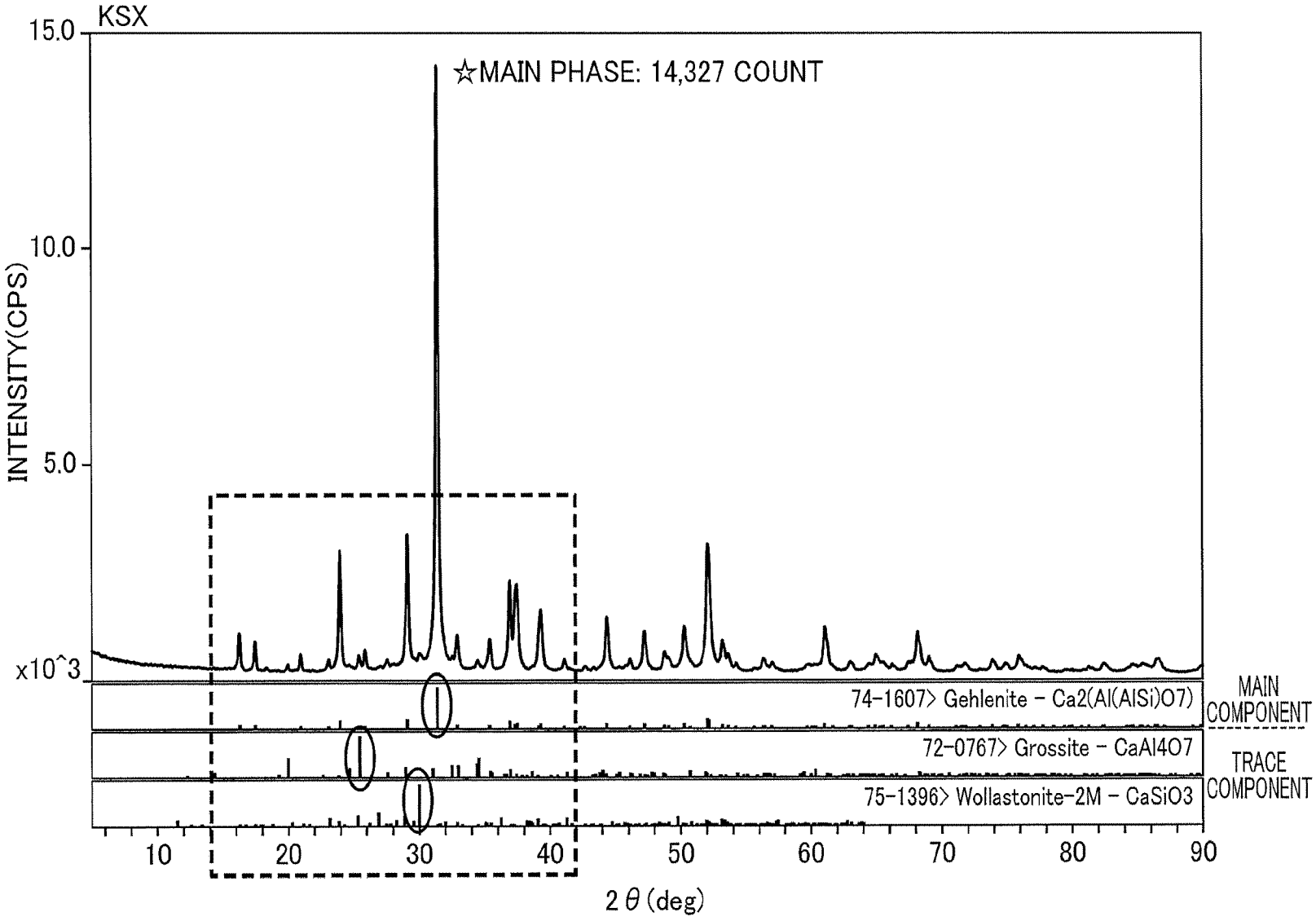
FIG. 1 is an X-ray diffraction diagram illustrating peak heights of a main phase and a second phase of a composite oxide powder according to the present embodiment.

The present inventor examined a cause, in a sintered compact obtained by sintering a material powder mixture with a composite oxide powder mixed, of a large difference in an amount of abrasion of a tool due to a slight difference in manufacture conditions even when a particle size and a chemical component ratio of the composite oxide are strictly adjusted.

As a result, it was found that a main cause was the variation of a ratio, to a target crystalline phase (hereinafter, referred to as "main phase"), of a phase present most next to the main phase (hereinafter, referred to as "second phase") among crystalline phases not a target phase.

Additionally, although it was expected that the less the above second phase is present, the less a tool abrades, it has been found that in practice, the tool abrades least when a ratio of the second phase present is within a specific range.

Further intensive studies of a constitution of a powder which enables an amount of abrasion of a machining tool due to addition of a composite oxide powder to be reduced more and stabilizes machinability based on the above knowledge have completed the present invention.

The present invention realizes a method for manufacturing a sintered compact having excellent machinability which allows for stable machining for a long period of time in a recent automatic machining line and which enables a machining tool to be used until the end of its life span without useless replacement, and realizes a powder mixture for iron-based powder metallurgy by which such a sintered compact can be obtained.

Hereinafter, description will be made of specific embodiments of the powder mixture for iron-based powder metallurgy and the method for manufacturing a sintered compact using the same according to the present invention.

For the powder mixture for iron-based powder metallurgy of the present embodiment, which is a powder mixture for iron-based powder metallurgy obtained by mixing an iron-based powder and at least one kind of powders selected from the group consisting of a Ca—Al—Si-based composite oxide powder and a Ca—Mg—Si-based composite oxide powder, it is in particular crucial to specify physical properties of composite oxide powders to be mixed.

A composite oxide used in the present embodiment is a composite oxide powder in which with a peak height of a main phase exhibiting the highest peak intensity by X-ray diffraction as 100, the composite oxide powder has a relative height of 40% or less, with respect to the peak height of the main phase, of a peak height of a second phase having the second highest peak intensity (hereinafter, sometimes referred to simply as "relative height of the second phase").

As shown in Patent Literatures 1 and 2, according to the so far proposed techniques, it was considered that machinability of a sintered compact could be stably increased simply by blending a Ca—Al—Si-based composite oxide or a Ca—Mg—Si-based composite oxide which has an element ratio (e.g., a ratio of Ca:Al:Si) obtained by a chemical analysis being a target composition and has a particle size adjusted within a specific range.

The present embodiment overturns such preconception as described above. Specifically, the studies by the present inventor have found that simply by adding a composite oxide having an element ratio obtained by a chemical analysis being a target composition and having a particle size adjusted within a specific range, an amount of abrasion of a machining tool cannot be stably reduced.

A Ca—Al—Si-based composite oxide or a Ca—Mg—Si-based composite oxide used so far as a component for improving machinability is considered to suppress abrasion of a machining tool by forming accretion on a tool surface by frictional heat and pressure generated during machining. However, simply by strictly adjusting a chemical composition and a particle size, it is impossible to stabilize a state of accretion formation on a tool surface and an amount of abrasion of the tool.

The present inventor used an X-ray diffraction device (X-ray diffraction device "RINT-1500" manufactured by Rigaku Corporation) and measured an X diffraction intensity of a composite oxide powder under conditions shown in Table 1 below to consider a relationship between a result of the measurement and machinability. As a result, it is found that with a peak height of a main phase exhibiting the highest peak intensity by X-ray diffraction as 100, by setting the composite oxide powder to have a relative height of 40% or less, with respect to the peak height of the main phase, of a peak height of a second phase having the second highest peak intensity, machinability of an obtained sintered compact is improved to reduce an amount of abrasion of a machining tool.

TABLE 1

| | | |
|---|---|---|
| Analysis Device | X-ray diffraction device RINT-1500, Product of Rigaku | |
| Analysis Conditions | Target | Cu |
| | Monochrome Ratio | monochrometer used |
| | Target Output | 40 kV-200 mA |
| | (Continuous Measurement) | θ/2θ Scan |
| | Slit | Divergence 1°, Scattering 1°, Light Reception 0.30 mm |
| | Monochrometer Light Receiving Slit | 0.60 mm |
| | Scan Rate | 2°/min |
| | Sampling Width | 0.02° |
| | Measurement Angle (2θ) | 10°~80° |

Figure 2:
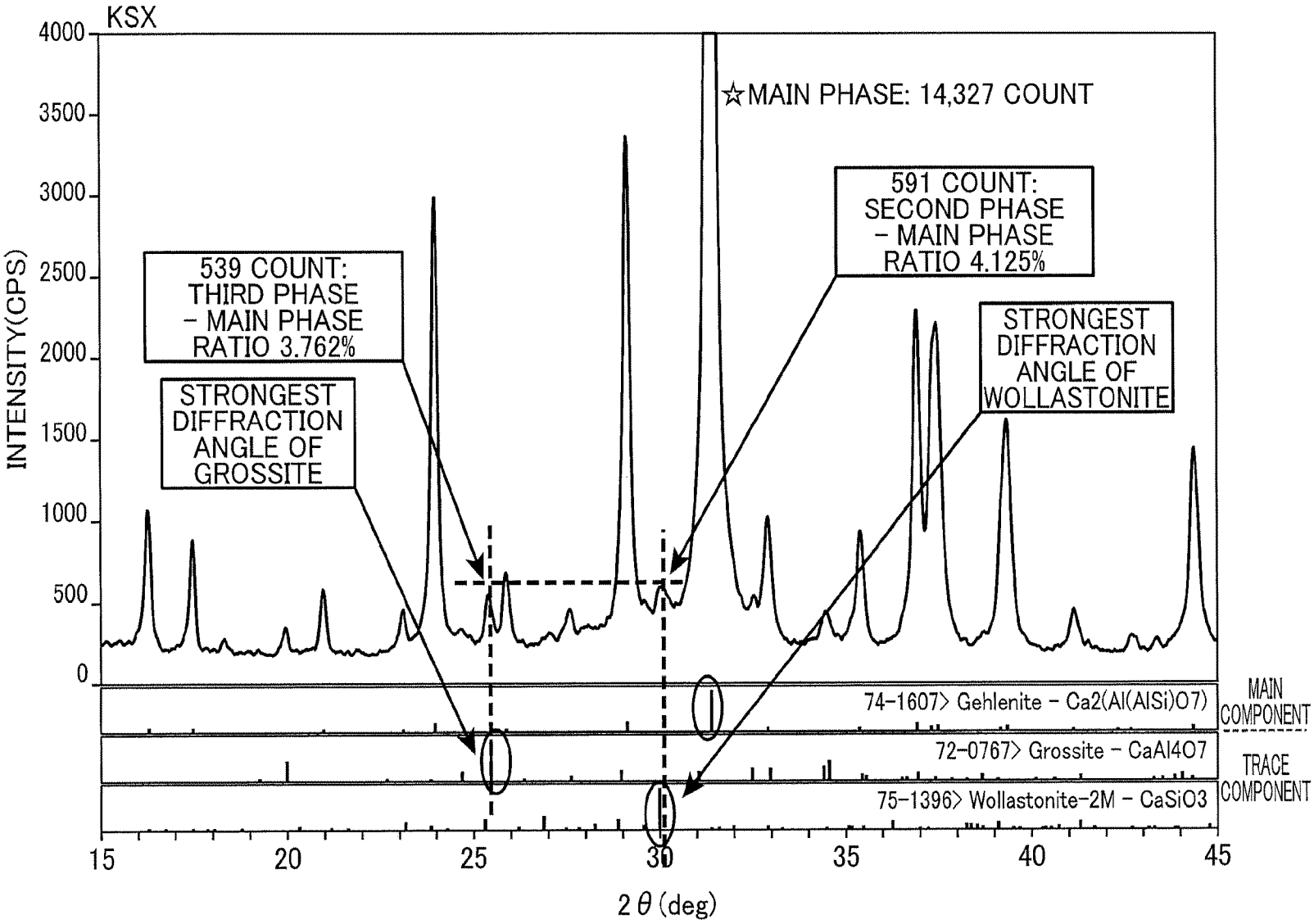
FIG. 2 is a partial enlarged view of FIG. 1.

FIG. 1 is an X-ray diffraction diagram showing one example of peak heights of a main phase and a second phase of a composite oxide powder according to the present embodiment. FIG. 2 is a partial enlarged view of FIG. 1. The example of X-ray diffraction shown in FIG. 1 and FIG. 2 represents an intensity (CPS: Count Per Second) of each phase of a composite oxide powder adjusted to have a component composition of $2CaO—Al_2O_3—SiO_2$, the intensity being obtained by X-ray diffraction under the conditions shown in Table 1.

FIG. 1 and FIG. 2 show that in a phase with gehlenite as a main component, i.e. a "main phase", an X-ray diffraction intensity appears highest and a peak intensity of a plane emitting the strongest beam is 14327 counts. It is also shown that grossite and wollastonite appear as phases other than gehlenite which is the main phase.

A relative height of a peak height which is an intensity exhibiting the strongest diffraction angle in each of these grossite and wollastonite is calculated with respect to a peak height of gehlenite as a main phase as 100.

Then, a phase having a relative height which is the highest next to the main phase is specified as a "second phase". In the example shown in FIG. 1 and FIG. 2, it is shown that wollastonite is specified as the second phase and a relative height in wollastonite is "4.125%".

A plane which emits the strongest beam of the composite oxide having the target composition is (211) in the $2CaO—Al_2O_3—SiO_2$ phase (gehlenite phase), is (−204) in a $CaO—Al_2O_3$-$2SiO_2$ phase (anorthite phase), and is (211) in a $CaO—MgO—SiO_2$ phase to be described later.

When thus obtained relative height of the second phase exceeds 40%, even if a ratio of each element obtained by a chemical analysis method meets the target composition, the composite oxide powder will have a crystalline structure rich in partly hard $Al_2O_3$ and $SiO_2$, and these hard phases conversely promote abrasion of a machining tool. It is therefore considered that by setting a composite oxide powder to have the above relative height of the second phase of 40% or less, abrasion of a machining tool is reduced to enable excellent machinability to be stably imparted to a sintered compact.

The above composite oxide powder more preferably has a relative height of the second phase of 20% or less. Setting the relative height of the second phase to be 20% or less makes a tool abrasion suppressing effect be more conspicuous. The relative height of the second phase is further more preferably 0.1% or more and 15% or less.

When the relative height of the second phase becomes less than 1.5%, the smaller the relative height of the second phase becomes, the more an amount of abrasion of a tool tends to be increased. Specifically, since the tool abrasion suppressing effect becomes most conspicuous when the relative height of the second phase is around 1.5%, the relative height of the second phase is most preferably on the order of 1.0% or more and 2.0% or less.

The composite oxide powder used in the present embodiment is at least one kind of powders selected from the group consisting of a Ca—Al—Si-based composite oxide powder and a Ca—Mg—Si-based composite oxide powder, and specifically, it is preferably a composite oxide with any one of the $2CaO—Al_2O_3—SiO_2$ phase, the $CaO—Al_2O_3$-$2SiO_2$ phase and the $CaO—MgO—SiO_2$ phase as a main phase.

The above $2CaO—Al_2O_3—SiO_2$ phase is a phase called gehlenite in a $CaO—Al_2O_3—SiO_2$-based ternary oxide phase diagram, and the $CaO—Al_2O_3$-$2SiO_2$ phase is a phase called anorthite. The $CaO—MgO—SiO_2$ phase is a phase located near a phase called monticellite in the $CaO—MgO—SiO_2$-based ternary oxide phase diagram.

Any of the above composite oxide powders, among those using the above phases as a main phase, may be used alone or two or more may be used in combination. In short, any composite oxide powder can be applied that exhibits such physical properties as described above when used.

A composite oxide powder used in the present embodiment is allowed to have such physical properties as described above by carefully selecting converter furnace slag generated in ironworks. Specifically, samples are collected at a plurality of points from converter water-granulated slag to select a sample matching a purpose according to a chemical component and by the X-ray diffraction method. Water-granulated slag matching a purpose can be adjusted to have a desired particle size by various kinds of grinders.

Alternatively, a composite oxide may be prepared by a melting synthesis method from a starting material obtained by blending each simple oxide powder such as $SiO_2$, $Al_2O_3$, or CaO so as to have a target composition of elements. Since even when the melting synthesis method is adopted, an amount of production of a second phase having a composition other than the target composition changes in the course of cooling, it is preferable to confirm in advance that the whole chemical composition is the target composition and appropriately set cooling conditions after melting synthesis to confirm that in the obtained composite oxide, a relative height of the above second phase is within a specific range by the X-ray diffraction method.

Although as the above cooling conditions, for example, regarding a cooling speed, precise measurement is difficult depending on situations such as a dissolution unit, a cooling method adopted, and the like, the more rapidly a molten composite oxide has been cooled, the smaller a relative height of a second phase tends to become. Since there are various kinds of commercially practical heating and cooling methods and a cooling speed changes also with one melting batch size, it is possible to appropriately determine a manufacture condition according to a device to be adopted.

The composite oxide used in the present embodiment preferably has a particle size of 50 μm or less as an average particle size and more preferably, a composite oxide having a particle size of 12 μm or less is suitably used. Since the finer a particle size of a composite oxide becomes, the more dispersing performance is improved, it is considered that even addition of a composite oxide having a low mass ratio can obtain a tool abrasion reduction effect.

However, since more cost is on the other hand required as a composite oxide becomes finer and finer, the composite oxide can be prepared to have a particle size within the above range in consideration of cost for pulverization. In view of the foregoing points, the particle size of the composite oxide is preferably 1 to 5 μm as an average particle size. The above average particle size of the composite oxide is assumed to be a value of a grain size $D_{50}$ at an integrated value 50% in a grain size distribution obtained using a laser diffraction type grain size distribution measurement device (Microtrac "MODEL 9320-X100", product of Nikkiso Co., Ltd.), i.e. a volume average particle size.

Examples of the iron-based powder used in the present embodiment include pure iron powders such as an atomized iron powder and a reduced iron powder, a partly diffused alloyed steel powder, a fully pre-alloyed steel powder, and a hybrid steel powder in which an alloy component is partly diffused in a fully pre-alloyed steel powder.

An iron-based powder is a main constituent component forming a powder mixture for iron-based powder metallurgy and is preferably contained in the powder mixture for iron-based powder metallurgy in a proportion of 60 mass % or more relative to the entirety. The iron-based powder is more preferably contained in proportion of 70 mass % or more.

The above blending proportion of the iron-based powder represents a proportion of the iron-based powder to a total mass of the powder mixture for iron-based powder metallurgy excluding a binder and a lubricant which will disappear in a sintering step among various kinds of additives to be described later. Hereinafter, when mass % of each component is defined, each definition represents a proportion to the total mass of the powder mixture for iron-based powder metallurgy excluding a binder and a lubricant.

The iron-based powder preferably has an average particle size of 50 μm or more in terms of the above volume average particle size and more preferably has an average particle size of 70 μm or more. Setting the average particle size of the iron-based powder to be 50 μm or more results in having excellent powder handleability. Also, the average particle size of the iron-based powder is preferably 200 μm or less and is more preferably 100 μm or less. Setting the average particle size of the iron-based powder to be 200 μm or less facilitates molding of a precise shape and obtains sufficient strength.

A blending amount of a composite oxide in the powder mixture for iron-based powder metallurgy is preferably set to be 0.02 mass % or more and 0.3 mass % or less. Setting the blending amount of the composite oxide to be 0.02 mass % or more enables impartation of excellent machinability. The blending amount of less than 0.02 mass % cannot obtain a sufficient machinability improvement effect and the blending amount exceeding 0.3 mass % increases costs due to use of the composite oxide, so that a strength and a size change rate of a sintered compact might be affected more or less.

The blending amount of the composite oxide more preferably has a lower limit of 0.05 mass % or more and more further preferably has a lower limit of 0.07 mass % or more. The blending amount of the composite oxide more preferably has an upper limit of 0.2 mass % or less and furthermore preferably has an upper limit of 0.15 mass % or less.

The powder mixture for powder metallurgy of the present embodiment may be appropriately blended with various kinds of additives such as a powder for an alloy, a graphite powder, a physical property improving powder, a binder, and a lubricant other than the above iron-based powder and composite oxide powders. Other than those described above, a trace amount of impurities is allowed to be inevitably contained in the course of manufacture of a powder mixture for iron-based powder metallurgy.

Examples of the above powder for an alloy include nonferrous metal powders such as a Cu powder, an Ni powder, an Molybdenum (Mo) powder, a Chromium (Cr) powder, a Vanadium (V) powder, an Silicon (Si) powder, and an Manganese (Mn) powder, and a cuprous oxide powder, one of which can be used alone or two or more of which can be used in combination.

As the above physical property improving powder, fumed silica and the like are exemplified when aiming at improving flowability of a powder mixture, and a stainless steel powder, a high-speed steel powder, a calcium fluoride powder, and the like are exemplified when improving abrasion resistance of a sintered compact.

The above binders are added to adhere a composite oxide powder, a powder for an alloy, a graphite powder, and the like to a surface of an iron-based powder. As such binders, a butene-based polymer, a methacrylic acid-based polymer, and the like are used. As a butene-based polymer, a 1-butene homopolymer consisting only of butene or a copolymer of butene and alkene is preferably used. Lower alkene is preferable as the above alkene, and ethylene or propylene is more preferable. As the methacrylic acid-based polymer, at least one kind is used which is selected from the group consisting of methacrylic acid methyl, methacrylic acid ethyl, methacrylic acid butyl, cyclohexyl methacrylate, methacrylic acid ethyl hexyl, lauryl methacrylate, methyl acrylate, and ethyl acrylate.

A content of the binder is preferably 0.01 mass % or more and 0.5 mass % or less relative to a total mass of the powder mixture for iron-based powder metallurgy, is more preferably 0.05 mass % or more and 0.4 mass % or less, and is further more preferably 0.1 mass % or more and 0.3 mass % or less.

The above lubricant is added to make it easy to eject, from a metal mold, a compact obtained by compressing a powder mixture for iron-based powder metallurgy in the metal mold. Specifically, when a lubricant is added to the powder mixture for iron-based powder metallurgy, a Ejection Force of drawing a compact from a metal mold is reduced to prevent generation of a crack in the compact and damage to the metal mold. The lubricant may be added to the powder mixture for iron-based powder metallurgy or may be applied to a surface of the metal mold.

A blending amount of the lubricant is preferably 0.01 mass % or more and 1.5 mass % or less relative to a total mass of the powder mixture for iron-based powder metallurgy, is more preferably 0.1 mass % or more and 1.2 mass % or less, and is further more preferably 0.2 mass % or more and 1.0 mass % or less. Because the content of the lubricant is 0.01 mass % or more, an effect of reducing a Ejection Force of a molded body can be easily obtained. Because the content of the lubricant is 1.5 mass % or less, a high-density sintered compact can be obtained easily and a sintered compact with a higher strength can be obtained.

As the above lubricants, at least one kind is used which is selected from the group consisting of a metal soap such as lithium stearate, calcium stearate, or stearate zinc, stearate monoamide, fatty acid amide, amide wax, hydrocarbon-based wax, stearate zinc, and cross-linked (meth)acrylic acid alkyl ester resin. Among these kinds, an amide-based lubricant is preferably used in terms of excellent performance of adhering a powder for an alloy, graphite, and the like on a surface of an iron-based powder and easiness in mitigating segregation of an iron-based powder mixture.

The powder mixture for iron-based powder metallurgy of the present embodiment can be prepared by mixing an iron-based powder, the above produced Ca—Al—Si-based composite oxide or Ca—Mg—Si-based composite oxide by using, for example, a machine stirring mixer. In addition to these powders, various kinds of additives are appropriately added such as a powder for an alloy, a graphite powder, a binder, and a lubricant. Examples of the above machine stirring mixer include a high-speed mixer, a Nauta mixer, a V-mixer, and a double cone blender. The order of mixing the above powders is not particularly limited. Although a mixing temperature is not particularly limited, 150° C. or less is preferable in terms of suppressing oxidization of an iron-based powder in a mixing step.

After the above produced powder mixture for iron-based powder metallurgy is filled in the metal mold, by applying a pressure of 300 MPa or more and 1200 MPa or less, a compact is obtained. The molding temperature then is preferably 25° C. or more and 150° C. or less.

A sintered compact can be obtained by sintering the above produced compact by an ordinary sintering method. Although any sintering condition can be applied as long as sintering is conducted in a non-oxidizing atmosphere or a reducing atmosphere, sintering is preferably conducted in, for example, a nitrogen atmosphere, a nitrogen and hydrogen mixed atmosphere, a hydrocarbon atmosphere, or the like at a temperature of 1000° C. or more and 1300° C. or less for five minutes or more and 60 minutes or less.

Thus manufactured sintered compact can be used for various kinds of machine part as a result of machining.

Thus manufactured sintered compact can be used as a machine part of an automobile, a farm machine, a power tool, a home appliance, and the like as a result of processing with various tools such as a machining tool as required. Examples of a machining tool for processing the above sintered compact include a drill, an end mill, an endmill, a turning tool for machining, a reamer, and a tup.

Although the above sintered compact is subjected to various kinds of heat treatments such as bright hardening-tempering, and cementation processing as required, since the Ca—Al—Si-based composite oxide powder and the Ca—Mg—Si-based composite oxide powder will not change in quality by these heat treatments, subjecting these powders to machining after various kinds of heat treatments is also included in the present invention.

The present specification discloses the technique in various modes as shown in the foregoing, and a main part of the technique will be summarized below.

A powder mixture for iron-based powder metallurgy according to one aspect of the present invention is a powder mixture which is obtained by mixing an iron-based powder and at least one kind of powders selected from the group consisting of a Ca—Al—Si-based composite oxide powder and a Ca—Mg—Si-based composite oxide powder, in which with a peak height of a main phase exhibiting the highest peak intensity by X-ray diffraction as 100, the composite oxide powder has a relative height of 40% or less, with respect to the main phase, of a peak height of a second phase having the second highest peak intensity.

Such a constitution as described above enables a powder mixture for iron-based powder metallurgy to be provided which enables production of a sintered compact that stably exhibits excellent machinability without having, when used as a tool, an amount of abrasion of the machining tool largely changing during machining.

In the present invention, the relative height is preferably 20% or less. The relative height is more preferably 0.1% or more and 15% or less. This enables the above effect to be more reliably achieved.

The composite oxide powder used in the present invention is preferably a composite oxide with any one of the $2CaO—Al_2O_3—SiO_2$ phase, the $CaO—Al_2O_3$-$2SiO_2$ phase, and the $CaO—MgO—SiO_2$ phase as a main phase. This enables the above effect to be more reliably achieved.

The present invention also includes a method for manufacturing a sintered compact by using the above powder mixture for iron-based powder metallurgy. The sintered compact obtained by the manufacturing method stably exhibits excellent machinability without having, when used as a tool, an amount of abrasion of the tool largely changing during machining.

Although operations and effects of the present invention will be specifically shown with respect to Examples in the following, Examples below do not limit the present invention and appropriate design changes according to the above purpose and a purpose to be described later are both included in the technical range of the present invention.

EXAMPLES

Example 1

A CaO powder, an $Al_2O_3$ powder, and an $SiO_2$ powder were mixed so as to have a component composition of $2CaO—Al_2O_3—SiO_2$, and 100 g of the mixture was inserted into an crucible and was heated at 1600° C. in the atmosphere until being completely dissolved. The following dissolved substances were prepared aiming at changing a cooling speed; (i) dissolved substances directly put into water and rapidly cooled; (ii) dissolved substances taken out of heating furnace with a take-out temperature changed and allowed to stand to cool to room temperature in the atmosphere; and (iii) dissolved substances cooled in the heating furnace for two days.

The obtained various kinds of composite oxides were coarsely pulverized so as to have an average particle size of 1 mm or less and further finely pulverized by a swirling type jet mill so as to have an average particle size within a range from 2.5 to 2.7 μm. The finely pulverized composite oxide powder was subjected to X-ray diffraction under the conditions shown in Table 1 and a relative height of a second phase with respect to a main phase was measured.

Next, a pure iron powder (product name: "300M", product of KOBE STEEL, LTD.) was mixed with 2 mass % of a copper powder (product name: "CuATW-250", product of FUKUDA METAL FOIL & POWDER CO., LTD.), 0.8 mass % of a graphite powder (product name: "CPB", product of Nippon Graphite Industry Co., Ltd.), 0.75 mass % of an amide-based lubricant (product name: "Acrawax C", product of LONZA), and 0.1 mass % of the above produced 2CaO—Al2O3-SiO2 powder to prepare a powder mixture for iron-based powder metallurgy. The above pure iron powder used then had an average particle size of 76 μm.

The above powder mixture for iron-based powder metallurgy was filled in a metal mold to mold a test piece having a ring-shape with an outer diameter of 64 mm, an inner diameter of 24 mm, and a thickness of 20 mm and having a compact density of 7.00 g/cm$^3$. The compact was sintered at 1130° C. for 30 minutes under an atmosphere of 10% $H_2—N_2$ in a pusher type sintering furnace to produce a sintered compact. Each of obtained samples of the sintered compact had a density of 6.85 g/cm$^3$.

An amount of abrasion of a turning tool (an amount of abrasion in a depth direction from a tool surface: μm) was measured by a toolmaker's microscope using the produced sintered compact machined by 2500 m by using a cermet tip (ISO type: SNGN120408 Nonbreaker) under the following conditions: a circumferential speed of 160 m/min; a cutting depth of 0.5 mm/pass; feed rate of 0.1 mm/rev; and under dry-condition.

Figure 3:
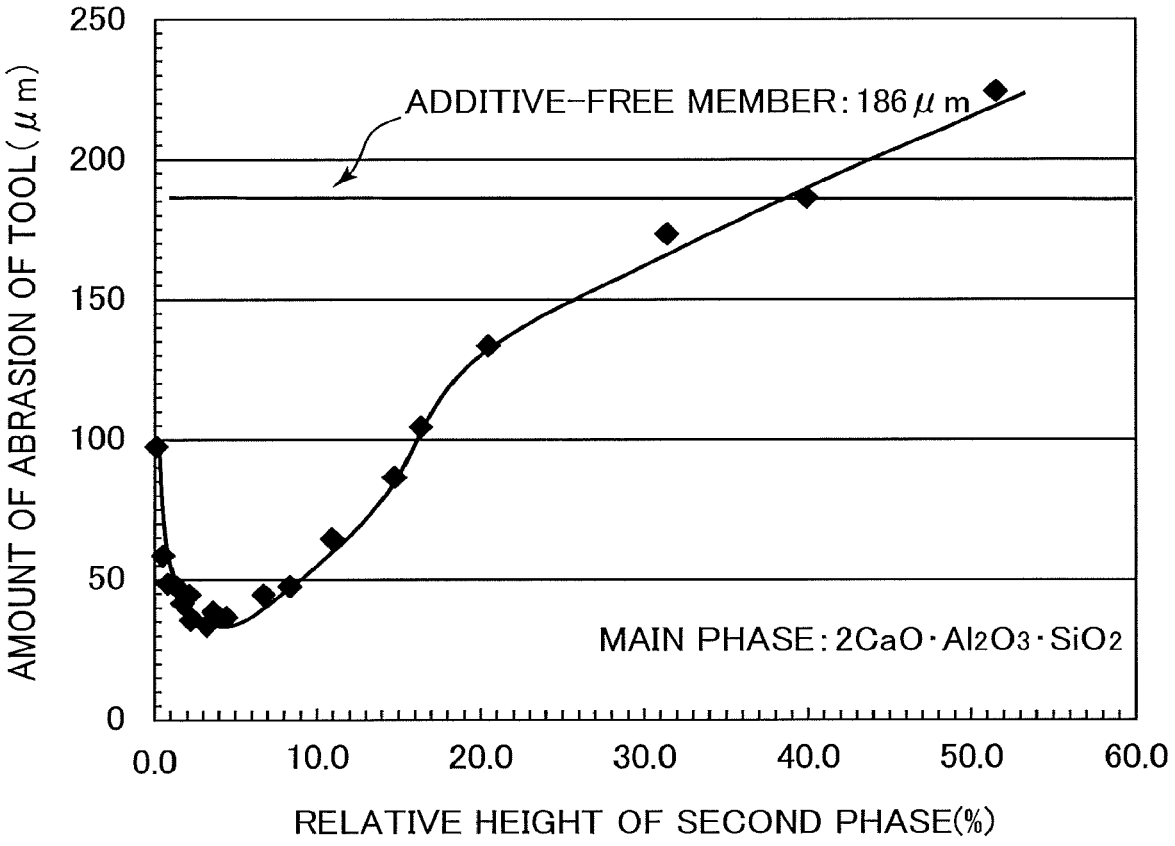
FIG. 3 is a graph showing a relationship between a relative height of a second phase of a composite oxide powder used with a $2CaO—Al_2O_3—SiO_2$ phase as a main phase and an amount of abrasion of a tool in Example.

Measurement results of a relative height of a second phase and an amount of abrasion of the tool are shown in Table 2 below. It is shown that the smaller a value of the amount of abrasion of the tool becomes, the more excellent becomes machinability of the sintered compact. On the basis of these results, FIG. 3 shows a relationship between a relative height of the second phase and the amount of abrasion of the tool, obtained when a composite oxide powder was used with the $2CaO—Al_2O_3—SiO_2$ phase as a main phase. FIG. 3 also shows an amount of abrasion of the machining tool obtained when an "additive-free member" with no composite oxide blended was machined.

TABLE 2

| Relative height of second phase (%) | Amount of abrasion of tool (μm) |
|---|---|
| 0.1 | 98 |
| 0.5 | 59 |
| 0.8 | 49 |
| 1.3 | 48 |
| 1.7 | 42 |
| 2.1 | 45 |
| 2.2 | 36 |
| 3.2 | 34 |
| 3.6 | 39 |
| 3.8 | 38 |

TABLE 2-continued

| Relative height of second phase (%) | Amount of abrasion of tool (μm) |
|---|---|
| 4.4 | 37 |
| 6.7 | 45 |
| 8.3 | 48 |
| 10.9 | 65 |
| 14.7 | 87 |
| 16.3 | 105 |
| 20.4 | 134 |
| 31.3 | 174 |
| 39.8 | 187 |
| 51.4 | 225 |

The following views are obtained from the foregoing results. First, it can be found that when the relative height of the second phase exceeds 40%, the amount of abrasion of the tool is increased rather than the additive-free member. This is considered that although the sintered compact has a target composition according to the chemical analysis, the composition partly differs from an ideal ratio of Ca, Al, and Si, so that a hard phase rich in $Al_2O_3$, for example, was generated to increase the amount of abrasion of the tool by the hard phase.

By contrast, when a relative height of the second phase became 20% or less, the amount of abrasion of the tool was abruptly reduced and when the relative height became 15% or less, and further 10% or less, the amount of abrasion of the tool was reduced and stabilized.

Although it was predicted that the amount of abrasion of the tool would be small when a composite oxide consisting only of a main phase was used, the amount of abrasion of the tool in practice showed a tendency to be conversely increased when the relative height of the second phase became less than 1.5%.

Figure 4:
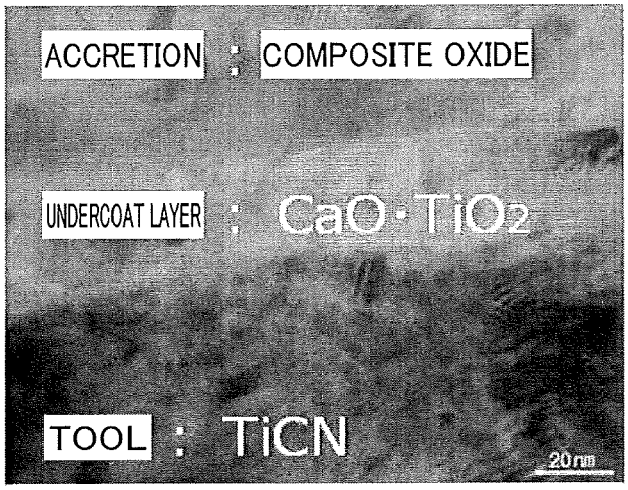
FIG. 4 is a photograph for a drawing showing the vicinity of a surface of a cutting tool used in the embodiment.

The reduction in the amount of abrasion of the tool by addition of a composite oxide is considered to be obtained by first allowing Ca in the composite oxide, which was dispersed in a sintered compact, to react with Ti included in the machining tool by heat and pressure generated during machining to form $CaO.TiO_2$ on a surface of the machining tool, and then by formation of an accretion called "Belag" via an undercoat of the formed $CaO.TiO_2$, thereby preventing direct contact between the machining tool and an iron-based sintered compact as a workpiece. A surface state of the machining tool then is shown in a picture for the drawing of FIG. 4.

It is considered that since a composite oxide slightly containing unstable phases rich in Ca, rather than a composite oxide consisting only of stable phases in the ternary oxide phase diagram such as $2CaO—Al_2O_3—SiO_2$, is more liable to react with Ti included in the machining tool to form an undercoat through which an accretion is formed, the amount of abrasion of the tool will be reduced. As described above, however, since excessive inclusion of a second phase promotes abrasion of the tool by a hard constitution, a suitable range is present.

Further, regarding a cooling speed of a dissolved substance of the mixture, it has been shown that the more quickly a sample was cooled from a molten state, the less a content of the second phase was.

Example 2

A powder mixture for iron-based powder metallurgy and a sintered compact were produced in the same manner as in Example 1 except that a CaO powder, an $Al_2O_3$ powder, and an $SiO_2$ powder were mixed so as to have a component composition of $CaO—Al_2O_3—SiO_2$ to prepare a composite oxide. A dissolution temperature and cooling conditions of the composite oxide then were also the same as those of Example 1.

Figure 5:
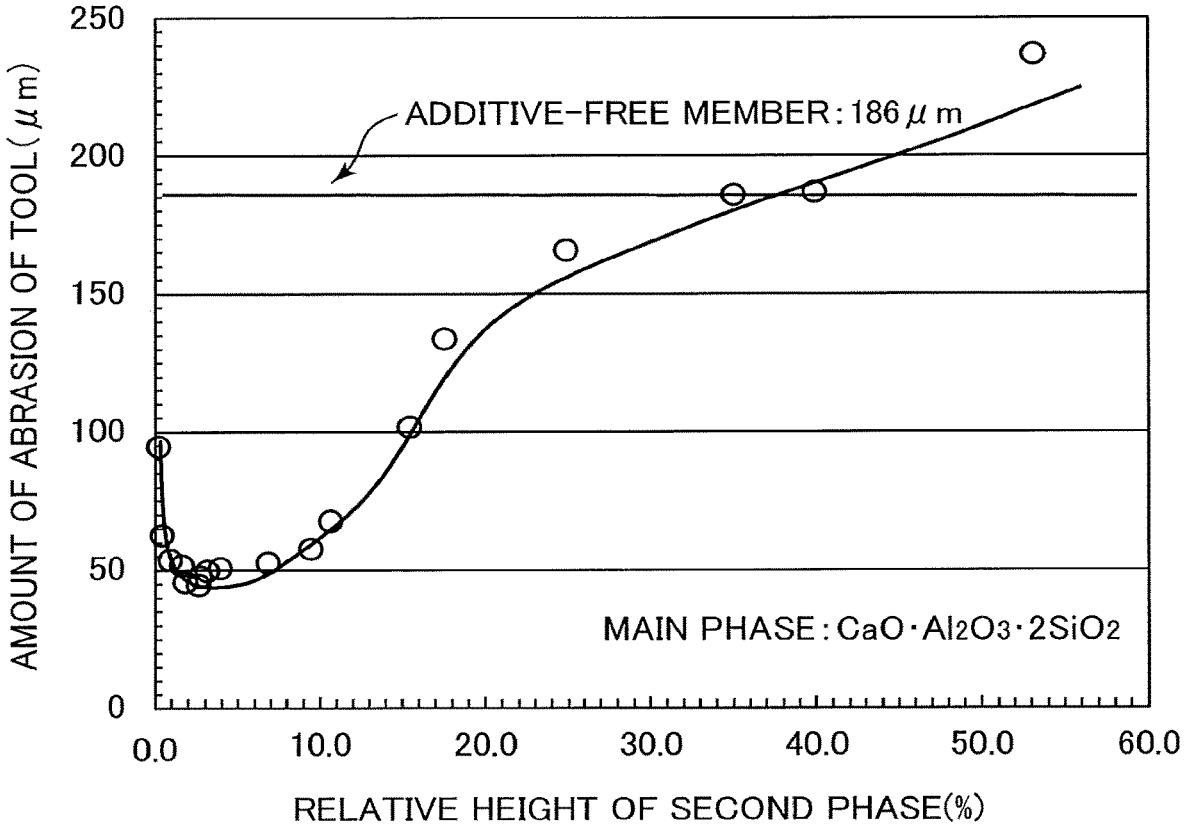
FIG. 5 is a graph showing a relationship between a relative height of a second phase of a composite oxide powder used with a $CaO—Al_2O_3$-$2SiO_2$ phase as a main phase and an amount of abrasion of a tool in Example.

Then, similarly to Example 1, a relative height of a second phase and an amount of abrasion of the tool were measured. Obtained results are shown in Table 3 below. On the basis of these results, FIG. 5 shows a relationship between a relative height of the second phase and the amount of abrasion of the tool, obtained when a composite oxide powder was used with the $CaO—Al_2O_3$-$2SiO_2$ phase as a main phase. Similarly to FIG. 3, FIG. 5 also shows an amount of abrasion of the machining tool obtained when an "additive-free member" with no composite oxide blended was cut.

TABLE 3

| Relative height of second phase (%) | Amount of abrasion of tool (μm) |
|---|---|
| 0.2 | 95 |
| 0.4 | 63 |
| 0.9 | 54 |
| 1.6 | 52 |
| 1.8 | 46 |
| 2.6 | 45 |
| 2.7 | 48 |
| 3.1 | 50 |
| 3.9 | 51 |
| 6.8 | 53 |
| 9.4 | 58 |
| 10.6 | 68 |
| 15.4 | 102 |
| 17.5 | 134 |
| 24.8 | 166 |
| 34.9 | 186 |
| 39.8 | 187 |
| 53.0 | 237 |

As is clear from these results, also in a case where a composite oxide is used in which $CaO—Al_2O_3$-$2SiO_2$ is a main phase and a second phase has a relative height within a predetermined range, the same tendency as in Example 1 is found.

Example 3

A powder mixture for iron-based powder metallurgy and a sintered compact were produced in the same manner as in Example 1 except that a CaO powder, an MgO powder, and an $SiO_2$ powder were mixed so as to have a component composition of $CaO—MgO—SiO_2$ to prepare a composite oxide. A dissolution temperature and cooling conditions of the composite oxide then were also the same as those of Example 1.

Figure 6:
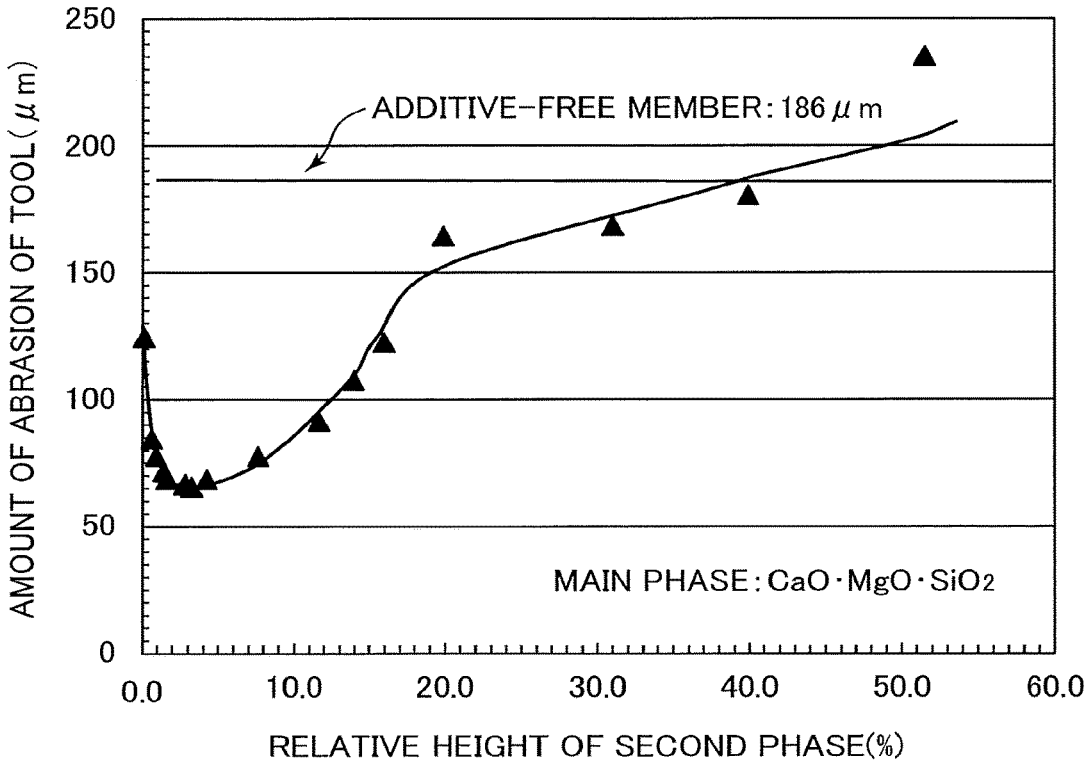
FIG. 6 is a graph showing a relationship between a relative height of a second phase of a composite oxide powder used with a $CaO—MgO—SiO_2$ phase as a main phase and an amount of abrasion of a tool in Example.

Then, similarly to Example 1, a relative height of the second phase and an amount of abrasion of the tool were measured. Obtained results are shown in Table 4 below. On the basis of these results, FIG. 6 shows a relationship between a relative height of the second phase and the amount of abrasion of the tool, obtained when a composite oxide powder was used with the $CaO—MgO—SiO_2$ phase as a main phase. Similarly to FIG. 3, FIG. 6 also shows an amount of abrasion of the machining tool when an "additive-free member" with no composite oxide blended was cut.

TABLE 4

| Relative height of second phase (%) | Amount of abrasion of tool (μm) |
|---|---|
| 0.1 | 125 |
| 0.6 | 85 |
| 0.9 | 78 |
| 1.4 | 72 |
| 1.6 | 69 |
| 2.8 | 67 |
| 3.2 | 66 |
| 4.2 | 69 |
| 7.6 | 78 |
| 11.6 | 92 |
| 13.9 | 108 |
| 15.9 | 123 |
| 19.8 | 165 |
| 30.9 | 169 |
| 39.8 | 181 |
| 51.4 | 236 |

As is clear from these results, also in a case where a composite oxide is used in which the CaO—MgO—$SiO_2$ phase is a main phase and a second phase has a relative height within a predetermined range, the same tendency as in Example 1 is found.

The present application claims priority from Japanese Patent Application No. 2016-234807 filed on Dec. 2, 2016, disclosure of which is all incorporated herein.

Although for expressing the present invention, it has been appropriately and fully described by way of the embodiments with reference to the specific examples and the like in the foregoing, it is to be understood that those skilled in the art can easily change and/or improve the above embodiments. Therefore, unless otherwise a mode of change or a mode of improvement made by those skilled in the art departs from the scope of right of claims recited in the Scope of Claims, the mode of change or the mode of improvement should be construed as being included therein.

INDUSTRIAL APPLICABILITY

The present invention has a wide range of industrial applicability in the technical filed related to iron-based powder metallurgy.

The invention claimed is:

1. A powder mixture for iron-based powder metallurgy, the powder mixture is obtained by a process comprising:

mixing an iron-based powder and at least one kind of powders selected from the group consisting of a Ca—Al—Si-based composite oxide powder and a Ca—Mg—Si-based composite oxide powder, wherein with a peak height of a main phase exhibiting the highest peak intensity by X-ray diffraction as 100, the composite oxide powder has a relative height of 0.1% or more and 40% or less, with respect to the main phase, of a peak height of a second phase having the second highest peak intensity.

2. The powder mixture according to claim 1, wherein the relative height is 0.1% or more and 20% or less.

3. The powder mixture according to claim 1, wherein the relative height is 0.1% or more and 15% or less.

4. The powder mixture according to claim 1, wherein the composite oxide powder includes any one of a 2CaO—$Al_2O_3$—$SiO_2$ phase, a CaO—$Al_2O_3$-2$SiO_2$ phase, and a CaO—MgO—$SiO_2$ phase as the main phase.

5. A method for manufacturing a sintered compact, the method comprising:

sintering the powder mixture according to claim 1.

6. A method for manufacturing a sintered compact, the method comprising:

sintering the powder mixture according to claim 2.

7. A method for manufacturing a sintered compact, the method comprising:

sintering the powder mixture according to claim 3.

8. A method for manufacturing a sintered compact, the method comprising:

sintering the powder mixture according to claim 4.

* * * * *